US006270635B1

(12) United States Patent
Woo

(10) Patent No.: US 6,270,635 B1
(45) **Date of Patent: *Aug. 7, 2001**

(54) CONSISTENT PLATING SYSTEM FOR ELECTROPLATING

(75) Inventor: Christy Mei-Chu Woo, Cupertino, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/299,871

(22) Filed: Apr. 27, 1999

(51) Int. Cl.[7] ..... C25B 15/00

(52) U.S. Cl. ..... 204/237; 204/275.1; 204/232; 204/242

(58) Field of Search ..... 204/228.6, 232, 204/237, 238, 275.1, 242; 205/101, 123

(56) References Cited

U.S. PATENT DOCUMENTS

| | | | | |
|---|---|---|---|---|
| 3,649,509 | * | 3/1972 | Morawetz et al. | 204/238 |
| 5,344,491 | * | 9/1994 | Katou | 204/238 |
| 5,391,285 | * | 2/1995 | Lytle et al. | 204/238 |
| 6,024,856 | * | 2/2000 | Haydu et al. | 204/232 |
| 6,200,436 | * | 3/2001 | Woo | 204/238 |

* cited by examiner

*Primary Examiner*—Bruce F. Bell
(74) *Attorney, Agent, or Firm*—Mikio Ishimaru

(57) ABSTRACT

A small plating solution reservoir of about 250-cc or less volume is used to provide plating of one wafer at a time with a precisely controlled, repeatable, plating solution. The reservoir is connected to basic plating solution and additives which are provided in desired concentrations by a valving and control system for single wafers and drained after the single wafer is plated.

20 Claims, 2 Drawing Sheets

CONSISTENT PLATING SYSTEM FOR ELECTROPLATING

CROSS-REFERENCE TO RELATED APPLICATIONS

The present application contains subject matter related to a concurrently filed U.S. Patent Application by Christy M. Woo entitled "Recycling Consistent Plating System for Electroplating". The related application is also assigned to Advanced Micro Devices, Inc. and is identified by docket number E0126.

TECHNICAL FIELD

The present invention relates generally to plating and more particularly to electro-chemical plating for semiconductor devices.

BACKGROUND ART

In the process of manufacturing integrated circuits, after the individual devices such as the transistors have been fabricated on the silicon substrate, they must be connected together to perform the desired circuit functions. This connection process is called "metalization" and is performed using a number of different photolithographic and deposition techniques. As the technology has been developing, electrochemical deposition or electroplating has become the preferred metalization process to deposit the bulk amount of conductive metal and metal alloys for interconnecting semiconductor devices.

Typically, the chemical bath used in the electroplating process is the most difficult parameter to control. In order to achieve successful deposition of metal into smaller and smaller, high aspect ratio features, such as semiconductor trenches or vias where the width is small compared to a large depth, different fluid additives must be added to the plating bath to enhance the electroplating filling capability. Each plating bath is used to process in excess of 1,500 wafers per batch of plating solution. The useful life of a batch of plating solution is determined by how quickly the additives are consumed during the plating process, how quickly the additives are destroyed by oxidation during processing, or how quickly detrimental by-products from the plating process accumulate. All these factors create unstable and changing formulations of the plating bath. At the end of the useful life of the batch of plating solution, it must be disposed of and a new batch of plating solution formulated.

In the past, the plating bath control method employed by the semiconductor industry was to monitor important components on an analysis bench outside the plating equipment. For example, for copper plating, the important components for an acid copper plating bath included analysis for copper ion, sulfuric acid, hydrochloric acid, other additives, and carbon by-product level. After analysis, the desired component concentration was maintained by adding a required amount of the individual components in a predetermined amount so as to maintain the bath in a predetermined, but relatively wide, range.

The analysis of the carbon by-products generally determined when the plating bath solution needed to be disposed of and a new batch formulated since there was no method of removing the carbon without also removing some of the other additives.

As the semiconductor moves into the use of materials which require greater use of plating processes and greater control over the chemicals being applied to achieve smaller and smaller semiconductor geometries, it has become more pressing that a solution be found to provide precise process control in semiconductor manufacturing.

DISCLOSURE OF THE INVENTION

The present invention provides a small recirculating reservoir added to a conventional semiconductor plating system in which additives to the plating solution can be controlled down to the single wafer level.

The present invention provides a plating system where there is no variation in the plating between successive plated products.

The present invention further provides a consistent and extremely tight control of component composition in a plating bath.

The present invention further eliminates the accumulation of detrimental plating by-products in a plating bath.

The present invention further eliminates the necessity to continuously sample and analyze bath components as the only means to achieve tight process control. This lowers costs and improves manufacturability.

The present invention further provides tight target plating for tight control of deposition by controlling the composition and/or impurities of the deposited film.

The present invention further provides for mixing of the basic plating solution and the additives immediately prior to use.

The above and additional advantages of the present invention will become apparent to those skilled in the art from a reading of the following detailed description when taken in conjunction with the accompanying drawings.

BEST MODE FOR CARRYING OUT THE INVENTION

Figure 1:
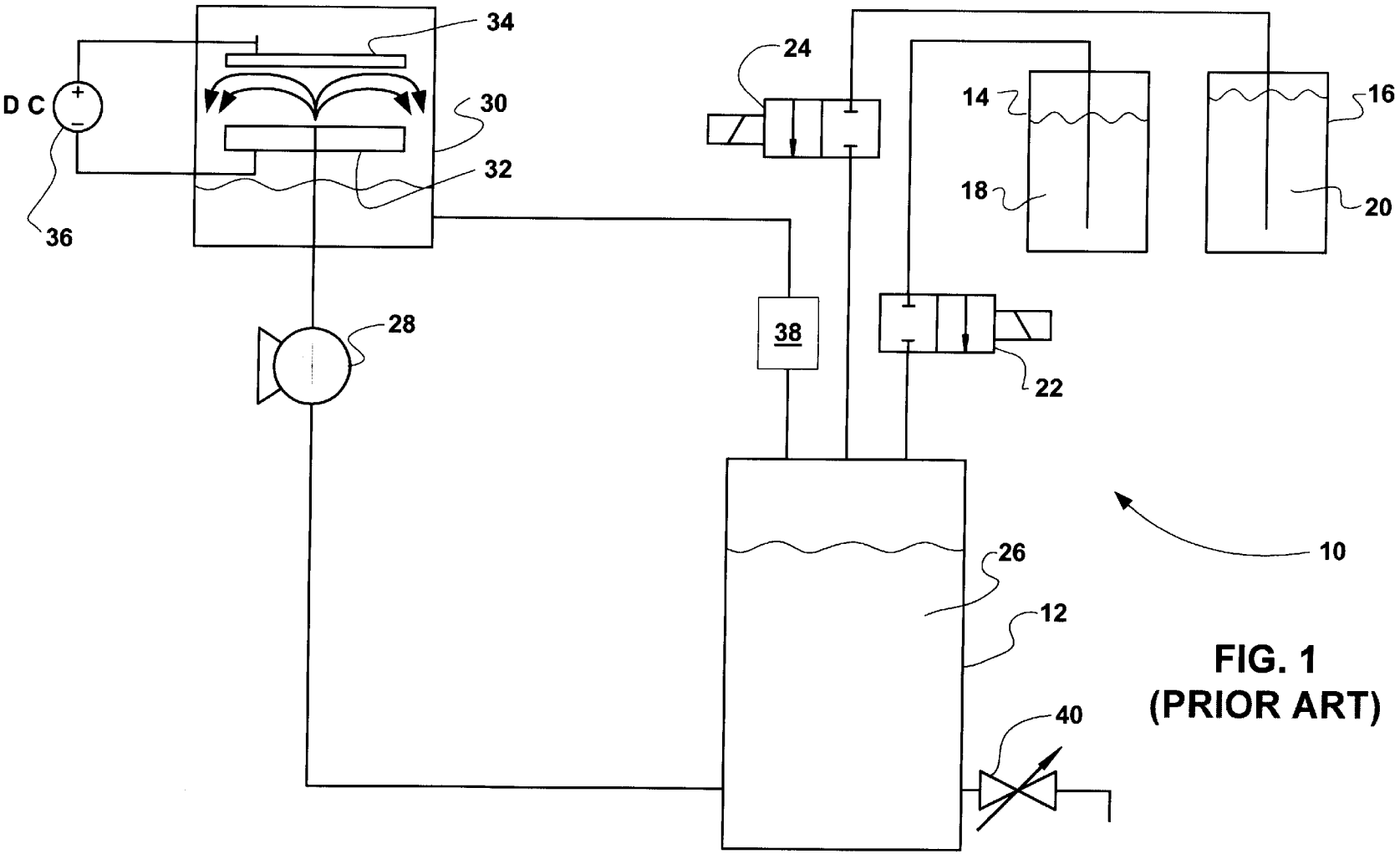
FIG. 1 (PRIOR ART)
FIG. 1 (PRIOR ART) shows a conventional electrochemical plating system.

Referring now to FIG. 1 (PRIOR ART), therein is shown a conventional electroplating system 10. The electroplating system 10 includes a plating solution tank 12 having connected thereto a plurality of containers such as containers 14 and 16 for containing replenishment additives 18 and 20, respectively. The containers 14 and 16 represent between one to ten containers, which contain additives such as de-ionized water, sulfuiic acid, hydrochloric acid, etc.

In the connection between the containers 14 and 16 are shut-off valves 22 and 24, which are generally manually controlled to allow the passage of the additives 18 and 20 into the plating solution tank 12 to be mixed with the solution therein to form the plating solution 26. The valves 22 and 24 are shown as being electrically or electronically controllable either from a remote location or by a simple processing control unit (not shown).

The plating solution tank 12 is connected by a pump 28 for pumping the plating solution 26 into a plating cell 30. The pump 28 pumps the plating solution 26 through an anode 32 against a semiconductor wafer 34 which acts as a cathode by being connected to a power supply 36 which is also connected to the anode 32. After use, the plating solution 26 is returned past a sampling port or a bath analysis tool 38 to the plating solution tank 12.

The plating solution tank 12 further has a drain 40 for emptying the plating solution when the additives are destroyed or oxidized, or the detrimental by-products have built up to an unacceptable extent.

Figure 2:
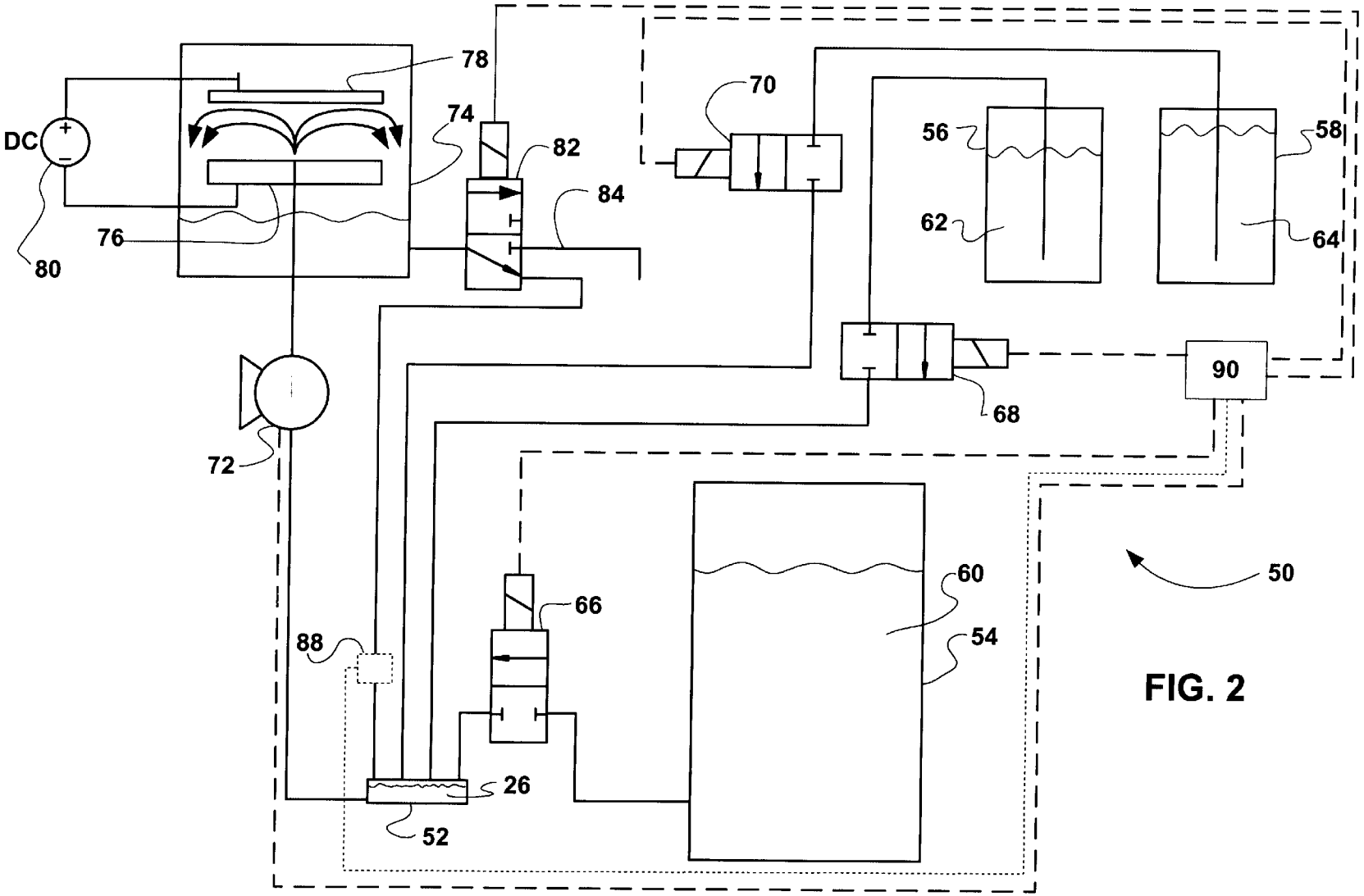
FIG. 2 shows an electro-chemical plating system according to the present invention.

Referring now to FIG. 2, therein is shown the plating system 50 of the present invention. The plating system 50 includes a plating solution reservoir 52 which is extremely small. Typically, it will contain the plating solution 26 in a volume of between 25 to 250 cubic centimeters as contrasted to the plating solution tank 12 which would contain many liters of plating solution 26.

The plating solution reservoir 52 is connected to a plurality of containers 54, 56, and 58. The container 54 contains the bulk base plating solution 60 with no additives, while the containers 56 and 58 contain additives 62 and 64, respectively. The containers 56 and 58 represent between one to ten containers, which contain such fluid additives as de-ionized water, sulfuric acid, hydrochloric acid, etc. For retrofits, the container 54 could be the plating solution bath 12 where the plating solution 26 could be premixed. However, this is less desirable since some of the additives degrade with time while mixed. The present invention provides mixing immediately before use in the preferred mode.

The containers 54, 56, and 58 are respectively connected through shut-off valves 66, 68, and 70 to the plating solution reservoir 52. The valves 66, 68, and 70 are shown as being electrically or electronically controllable by a control mechanism 90, such as a computer or microprocessor. The control mechanism 90 may also be a simple timer since the "one-shot" operation of the present invention lends itself to one-time setup and continuous operation on a time basis.

A pump 72 pumps the plating solution 26 from the plating solution reservoir 52 to a plating cell 74. In the plating cell 74, the plating solution 26 is pumped through an anode 76 against a semiconductor wafer 78 which acts as a cathode by being connected to a power supply 80 which is also connected to the anode 76. As would be evident to those skilled in the art, the present invention would also be applicable to electro-less plating.

The plating cell 74 is connected by a three-way valve 82, which returns the plating solution 26 to the plating solution reservoir 52 or sends it to a drain 84. The valve 82 is shown as being electrically or electronically controllable, but in the present invention, it may also be a simple timer controlled valve.

Optionally disposed between the three-way valve 82 and the plating solution reservoir is an analysis tool 88. The analysis tool 88 would be used to monitor the composition of the plating solution 26 and provide input to the control mechanism 90. As previously described, the analysis tool 88 could be a port for taking samples of the plating solution upon initial startup or recalibration since the present invention eliminates the need for continuous monitoring.

In the past, as shown in FIG. 1 (PRIOR ART), an entire batch of plating bath solution 26 was made up in the plating tank 12 by pouring the basic solution into the plating solution tank 12 and adding the additives 18 and 20 by manually opening the valves 22 and 24.

The plating bath solution 26 was then pumped through the pump 28 into the plating cell 30, past the anode 32 to bathe the wafer 34. The power supply 36 would be energized and the anode 32 would charge the plating bath solution 26 and so cause electro-chemical deposition of a material such as copper on the wafer 34 which acted as a cathode. After being used to plate the wafer 34, the partially depleted plating solution 26 with detrimental by-products would be recirculated back to the plating solution tank 12.

Periodically, the recirculated plating solution 26 would be sampled and the sample analyzed using other equipment. More recently, in-situ bath analysis tools have been developed and samples would be either periodically or continuously analyzed at the bath analysis tool 38. After the plating bath solution 26 reaches certain limits, the valves 22 and 24, which are electronically controllable, would be opened to add additives 18 and 20, respectively, to the plating solution tank 12.

After a large number of wafers had been plated and the chemical reactions had increased the detrimental reaction by-products to the point where the plating was about to deteriorate, the drain valve 40 would be opened to empty the plating solution tank 12. The unusable plating bath solution 26 is currently discarded.

As would be evident, the plating solution 26 reaching the wafer 34 would change during the operation of the process so there would be significant differences between the first and last wafers. Even from wafer to wafer, there would be variations. As semiconductor critical line widths decrease, these variations become more and more serious of a problem.

In the present invention, the shut-off valves 66, 68, and 70 would be opened to fill the plating solution reservoir 52 with a combination of the plating solution 60 and the additives 62 and 64 to make up the plating solution 26. This operation would be performed immediately before use for each wafer or each small batch of wafers, such a single wafer boatload of about twenty-five wafers. The plating solution 26 would then be pumped by the pump 72 to the plating cell 74 past the anode 76 to bathe the wafer 78. The power supply 80 would charge the anode so as to charge the plating solution 26 to electro-chemically deposit the plating material on the wafer 78 acting as a cathode.

Initially, the plating solution 26 would be circulated back to the plating solution reservoir 52 through the valve 82. For single shot operation for single wafers, it is unlikely that the basic plating solution 60 or any of the additives 62 or 64 need to be made up. However, for a small number of wafers, such as a wafer boat load of twenty or so wafers, it might be necessary for the vales 66, 68, and 70 to be opened by the control mechanism 90 to make up used up plating solution or additives.

After the desired level of plating has been achieved on the wafer 78, the wafer 78 would be removed and the plating reservoir solution 26 would be drained at the valve 82 to the drain 84. After the plating solution reservoir 52 is emptied, the cycle would restart with the shut-off valves 66, 68, and 70 being opened to refill the plating solution reservoir 52 with freshly mixed plating solution 26 for the next wafer.

The above cycling for each wafer could be performed by a control mechanism 90 which is a computer, microprocessor, or microcontroller; however, in the best mode, the optimal combination of plating solution would be determined just once and simple timers could be used to sequence all the cycles.

It would be understood by those skilled in the art that the plating system 50 can be used to provide exactly repeatable processing of each wafer for an unlimited number of wafers. The 25 to 250 cc plating solution reservoir would contain sufficient plating material to plate one wafer.

In an alternate embodiment, the analysis tool 88 can be used to control the shut-off valves 66, 68, and 70 as well as the pump 72 to provide a completely automated system for many different types of wafers. However, it should be understood that the present invention can be practiced least expensively merely using timer controlled shut-off valves 66, 68, and 70 and a timer controlled pump 72. This is because it is possible to run one test wafer 78 with the proper timing sequence and use that sequence for each subsequent wafer and achieve the same processing on each of the subsequent wafers.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

The Invention claimed is:

1. A plating system for plating objects comprising:

a basic plating solution container capable of containing basic plating solution;

an additive container capable of containing an additive for the basic plating solution;

a plating solution reservoir connected to said plating solution container and said additive container, said plating solution reservoir for containing plating solution formed from the basic plating solution mixing with the additive, said plating solution reservoir capable of containing only sufficient plating solution for the single object; and a plating cell connected to said plating solution reservoir and capable of containing the single object, said plating cell capable of bathing the single object to be plated in the plating solution.

2. The plating system as claimed in claim 1 including:

a plating solution valve disposed between said basic plating solution container and said plating solution reservoir for metering the flow of basic plating solution therebetween;

an additive valve disposed between said additive container of and said plating solution reservoir for metering the flow of additive therebetween; and said plating solution reservoir capable of having said basic plating solution and said additive mix therein.

3. The plating system as claimed in claim 2 including:

a return valve disposed between said plating cell and said plating solution reservoir capable of returning the plating solution to the plating solution reservoir; said return valve capable of draining the plating solution from the plating cell;

a pump for circulating the plating solution between said plating cell and said plating solution reservoir; and a control mechanism connected to said plating solution valve, said additive valve, said return valve, and said pump for controlling the mixing of the plating solution and the additive, said control mechanism for controlling the pumping of the plating solution and the return and draining of the plating solution from the plating cell.

4. The plating system as claimed in claim 3 wherein said control mechanism includes a timer.

5. The plating system as claimed in claim 3 wherein said control mechanism includes an analysis tool.

6. The plating system as claimed in claim 3 wherein said control mechanism is computerized.

7. A semiconductor wafer plating system comprising:

a basic plating solution container capable of containing basic plating solution;

an additive container capable of containing an additive for the basic plating solution;

a plating solution reservoir connected to said plating solution container and said additive container, said plating solution reservoir for containing plating solution formed from the basic plating solution mixing with the additive, said plating solution reservoir capable of containing only sufficient plating solution for a single wafer; and a plating cell capable of containing a single wafer to be plated and capable of bathing the single wafer with plating solution.

8. The plating system as claimed in claim 7 including:

a plating solution valve disposed between said basic plating solution container and said plating solution reservoir for metering the flow of basic plating solution therebetween; and an additive valve disposed between said additive container and said plating solution reservoir for metering the flow of additive therebetween;

said plating solution reservoir capable of having said basic plating solution and said additive mix therein.

9. The plating system as claimed in claim 8 including:

a return valve disposed between the plating cell and the plating solution reservoir capable of returning the plating solution to said plating solution reservoir; said return valve capable of draining the plating solution from said plating cell;

a pump for pumping the plating solution from said plating solution reservoir to said plating cell; and a control mechanism connected to said valves and to said pump for controlling the mixing and pumping of the plating solution, said control mechanism for controlling the return and draining of the plating solution from the plating cell; said control mechanism returning the plating solution while the single wafer is being plated and draining the plating solution when the single wafer is plated.

10. The plating system as claimed in claim 9 wherein said control mechanism includes a timer whereby said valves and pump are time controlled.

11. The plating system as claimed in claim 9 wherein said control mechanism includes an analysis tool and is responsive thereto to cause said control mechanism to maintain a precise composition of the plating solution.

12. The plating system as claimed in claim 9 wherein said control mechanism includes a microcontroller.

13. The plating system as claimed in claim 9 including:

an anode disposed in the plating cell to charge the plating solution;

a cathode connectable to the object to be plated; and a power supply connectable to said anode and cathode to cause electrochemical plating of the wafer.

14. A plating system for plating semiconductor wafers comprising:

a plating solution bath capable of containing a large volume of basic plating solution;

an additive container capable of containing an additive for the basic plating solution;

a plating solution reservoir consisting of a reservoir capable of containing less than about 250 cubic centimeters of plating solution, said plating solution reservoir connected to said plating solution bath and said additive container, said plating solution reservoir for containing the plating solution formed from the basic plating solution mixing with the additive;

a plating cell capable of containing a single semiconductor wafer to be plated; and a pump connected to said plating solution reservoir capable of pumping the plating solution into said plating cell against said single semiconductor wafer.

15. The plating system as claimed in claim 14 including:

a plating solution valve disposed between said plating solution bath and said plating solution reservoir for metering the flow of basic plating solution therebetween;

an additive valve disposed between said additive container and said plating solution reservoir for metering the flow of additive therebetween;

said plating solution reservoir capable of having the basic plating solution and the additive mix therein;

a return valve disposed between said plating cell and said plating solution reservoir capable of returning the plating solution to said plating solution reservoir; said return valve capable of draining said plating solution from said plating cell; and a control mechanism for controlling said valves and said pump for the mixing of the plating solution and the pumping of the plating solution, said control mechanism for controlling the return and draining of said plating solution from said plating cell.

16. The plating system as claimed in claim 15 wherein said control mechanism includes a timer.

17. The plating system as claimed in claim 15 wherein said control mechanism includes an analysis tool.

18. The plating system as claimed in claim 15 wherein said control mechanism includes a microcontroller.

19. A plating system for plating semiconductor wafers comprising:

a plating solution container capable of containing basic plating solution;

an additive container capable of containing an additive for the basic plating solution;

a plating solution reservoir connected to said plating solution bath and said additive container, said plating solution reservoir for containing the plating solution formed from the basic plating solution mixing with the additive;

a plating cell capable of containing a single semiconductor wafer to be plated;

a return valve disposed between said plating cell and said plating solution reservoir capable of returning the plating solution to said plating solution reservoir; said return valve capable of draining said plating solution from said plating cell; and a control mechanism for controlling said valves for the mixing of the plating solution, said control mechanism for controlling the return of said plating solution from said plating cell for a predetermined number of semiconductor wafers and draining said plating cell after the predetermined number of semiconductor wafers.

20. A plating system for plating semiconductor wafers comprising:

a basic plating solution container capable of containing basic plating solution;

an additive container capable of containing an additive for the basic plating solution;

a plating solution reservoir connected to said plating solution container and said additive container, said plating solution reservoir for containing plating solution formed from the basic plating solution mixing with the additive; and a plating cell connected to said plating solution reservoir and capable of containing the single object, said plating cell capable of bathing the single semiconductor wafer to be plated in the plating solution;

a plating solution valve disposed between said plating solution bath and said plating solution reservoir for metering the flow of basic plating solution therebetween;

an additive valve disposed between said additive container and said plating solution reservoir for metering the flow of additive therebetween;

a return valve disposed between said plating cell and said plating solution reservoir capable of returning the plating solution to said plating solution reservoir, said return valve capable of draining said plating solution from said plating cell; and a control mechanism for controlling said valves for the mixing of the plating solution immediately before plating, said control mechanism for controlling the return and draining of said plating solution from said plating cell.

* * * * *